United States Patent [19]

Lakic

[11] Patent Number: 4,782,602

[45] Date of Patent: Nov. 8, 1988

[54] SHOE WITH FOOT WARMER INCLUDING AN ELECTRICAL GENERATOR

[76] Inventor: Nikola Lakic, 73-355 Guadalupe Ave. Unit M, Palm Desert, Calif. 92260

[21] Appl. No.: 54,189

[22] Filed: May 26, 1987

[51] Int. Cl.[4] ..... A43B 7/02

[52] U.S. Cl. ..... 36/2.6; 219/211; 36/117

[58] Field of Search ..... 36/2.6, 117, 120, 136; 219/211

[56] References Cited

U.S. PATENT DOCUMENTS

| | | | |
|---|---|---|---|
| 1,506,282 | 8/1924 | Barbieri | 219/211 X |
| 1,918,276 | 7/1933 | Lillard | 36/2.6 |
| 3,534,391 | 10/1970 | Bauer | 219/211 |
| 4,420,893 | 12/1983 | Stephan | 36/117 X |
| 4,674,199 | 6/1987 | Lakic | 36/2.6 |

*Primary Examiner*—Donald Watkins
*Attorney, Agent, or Firm*—Plante Strauss Vanderburgh

[57] ABSTRACT

There is disclosed an inner shoe for a molded ski boot which includes a foot warmer mechanism having an electrical resistance heater, an electrical generator, a mechanical translator to translate vertical movements of the wearer's heel into uni-directional rotational movement of a flywheel, and a gear box mechanically coupling the flywheel to the electrical generator. Specific features of the mechanism include: a shock absorbing resilient coupling of the flywheel to prevent damaging the mechanism while juming or otherwise subjecting the shoe to hard usage; interchangeable generators and gear boxes to accommodate wearer's of varied size and weight as well as for varied intensity of activity; and an entirely sealed, remote latch to lock the mechanical drive out of operation.

19 Claims, 7 Drawing Sheets

SHOE WITH FOOT WARMER INCLUDING AN ELECTRICAL GENERATOR

BACKGROUND OF THE INVENTION

1. The Field of the Invention

This invention relates to a warming device for shoes and boots, and in particular to a simple device for generating electricity which is used to produce heat within a ski boot or clothing such as gloves, mittens, etc.

2. Brief Statement of the Prior Art

U.S. Pat. No. 3,534,391 discloses an electrical generator which is mounted on the outside of a ski boot which is driven from a tether that is connected between the generator and a ski. The generated current is passed through heating elements located in the ski boot. The external mounting and tether render this device quite cumbersome and difficult to use.

French Patents 701,420 and 2365-973 and U.S. Pat. No. 3,977,093 disclose shoes with batteries mounted in the heels, and with electric resistance heaters in the soles of the shoes. Batteries require frequent replacement, and are particularly inefficient in a cold environment.

U.S. Pat. No. 1,506,282 discloses an electric generator mounted in a telescoping heel of a shoe which generates electricity for an electric lamp, heating coil, wireless outfit or a therapeutic appliance. A telescoping heel of this design would be very difficult to seal against water and mud, and the patented device would most likely be limited to indoor applications.

U.S. Pat. Nos. 2,442,026 and 1,272,931 disclose air pumps which are located in the heels of shoes and operated during walking. In the first mentioned patent, alcohol vapors are mixed with the air stream and passed over a catalyst to generate heat. This system is cumbersome and difficult to use, and it requires replenishing the alcohol. Also, the heater elements are open in the shoe for air and gas circulation. In U.S. Pat. No. 1,272,931, the air is forced through constricted passageways to generate heat by compression. The heated air is openly discharged into the shoe, as there is no provision for a closed loop air path.

U.S. Pat. No. 382,681 discloses an armature which is mounted in a heel and manually rotated to generate heat by friction, which is dissipated in the shoe by metal conductors. U.S. Pat. No. 3,493,986 discloses an inner sole for a shoe which is formed of piezoelectric or magnetostrictive material which generate heat while the user walks.

U.S. Pat. No. 2,475,092 discloses a bouncing skate having spring coils on the bottom of its sole. German Patents 180866 and 620,963, and U.K. Patent 443,571 disclose springs mounted within a shoe for orthopedic purposes. None of these patents disclose shoe heaters.

U.S. Pat. No. 4,507,877 discloses a heater for a ski boot which is mounted on the inner shoe of the boot and which includes rechargeable storage batteries, control switch and electrical heating coil. Products of this design have been marketed with chargeable and with nonrechargeable batteries. These units do not provide any sustained heating, but are useful only to provide monetary heating because of the limited storage capacity of small batteries and the low efficiencies which they experience at sub-freezing temperatures.

All of the aforementioned attempts have failed to provide a practical self sustaining heater within a shoe which harnesses the movement between the wearer's heel and the heel of the shoe to generate heat. This relative movement can be sufficient, particularly when the wearer's weight is applied, to generate the necessary heat, provided a practical heat generator can be installed within the narrow confines of the shoe and heel, without significantly affecting its external appearance and comfort.

BRIEF DESCRIPTION OF THE INVENTION

This invention comprises a foot warmer mechanism for a shoe, particularly for a ski boot. The foot warmer mechanism is mounted entirely on an insert for the outer boot or shoe, and includes an electrical resistance heater, an electrical generator, a mechanical transducer to translate vertical movements of the wearer's heel into uni-directional rotational movement of a flywheel, and a reduction gear box mechanically coupling the flywheel to the electrical generator. Specific features of the mechanism include:. a shock absorbing resilient coupling of the flywheel to prevent damaging the mechanism while jumping or otherwise subjecting the shoe to hard usage; interchangeable generators and gear boxes to accommodate wearer's of varied size and weight as well as for varied intensity of activity; and a remote latch to lock the mechanical drive out of operation.

BRIEF DESCRIPTION OF THE DRAWINGS

The invention will be described with reference to the FIGURES, of which.

DESCRIPTION OF PREFERRED EMBODIMENT

Figure 1:
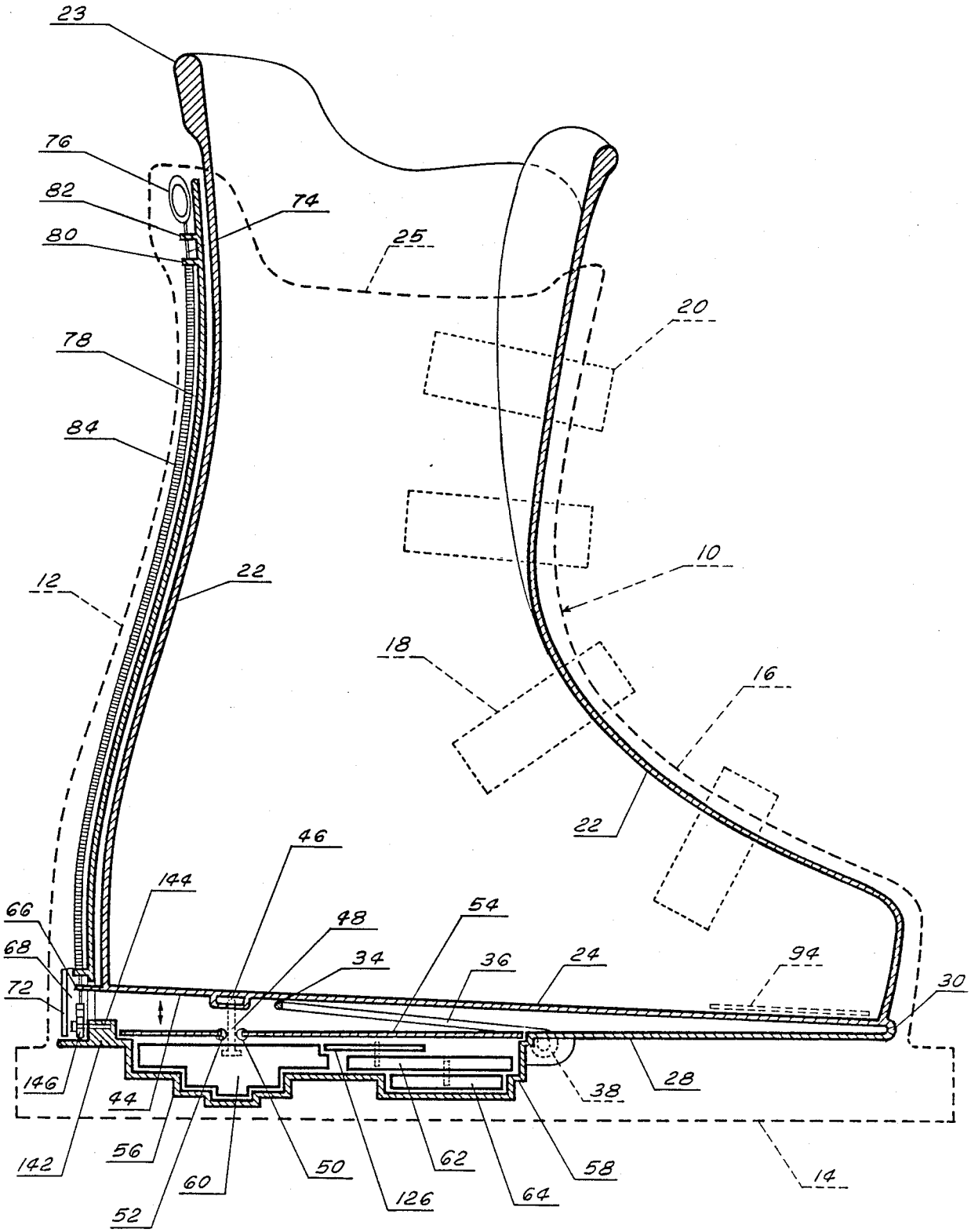
FIG. 1 is an elevational sectional view of a ski boot fitted with the foot warmer invention.

Referring now to FIG. 1, the invention is shown as applied to the inner shoe of an outwardly appearing, conventional ski boot 10. The ski boot 10 is shown in phantom lines and comprises a molded plastic shell 12 with a molded outer sole 14 and a plastic molded upper portion 16. The upper portion 16 can be spread or opened to permit moving the boots on and off the wearer's foot and has a plurality of fastening buckles 18 and 20 to secure the upper portion 16 in a snug conforming fit about the wearer's ankle and foot. Some of the fastener buckles, particularly buckles 18 which are over the instep are provided with adjustment for controlled variation of their tension, thereby providing control over the relative degree of movement of the foot within the boot 10.

In the conventional outer ski boot 10, the outer sole 14 is hollow form with reinforcing ribbing (not shown) which extends longitudinally and transversely across the outer sole 14, subdividing its hollow interior into a number of recesses or compartments.

The inner shoe 22 for the ski boot 10 is shown in elevational cross sectional view and comprises a snug fitting sock having an upper neck 23 which extends above the upper edge 25 of the upper portion of the ski boot 10 and with an integral lower sole 28.

The footwarmer of the invention is applied to the inner shoe 22 by molding compartments 56 and 58 in the lower sole 28 of the inner shoe 22 to receive the major components of the electrical generating mechanism. These include the mechanical transducer 60, the gear box 62 and the electrical generator 64. The aforementioned major components are located at the heel and instep of the inner shoe 22 in the aforementioned molded compartments 56 and 58.

The inner shoe 22 also includes an inner sole 24 which is a stiff, or relatively non-flexible plate that is pivotally secured to the lower sole 28 of the inner shoe 22 at its toe end. Preferably these are molded together of the same plastic as used to form the lower sole 28, thereby providing an integral hinge 30 at the toe of the inner shoe 22. The inner sole 24 is resiliently biased upwardly by arm 34 which is secured by arm 36 to coil spring 38. The inner sole 24 has a bracket 42 on its undersurface 44, centrally located in the heel area, which receives the upper end 46 of post 48 which is slidably mounted in an aperture 50 which supports a seal 52 in a cover plate 54 which is removably mounted over the compartments 56 and 58. The cover plate 54 is preferably sized to fit sufficiently tight to seal the compartments 56 and 58, or alternatively, a resilient seal or rubber or flexible plastic can be placed about the cover. The post 48, as hereinafter described, is mechanically coupled to the mechanical transducer 60 to translate reciprocating vertical motion to unidirectional rotation of a horizontal flywheel within the mechanical transducer.

At the heel end, the inner sole 24 has a distal tab 66 which projects into a brake compartment 68 formed as a pocket behind the heel of the inner shoe 22. Preferably the brake compartment 68 is covered by a removable, vertical plate 72. An actuator cable 74 extends from the brake compartment 68 to the upper portion of the inner shoe 22 and is provided with a suitable handle, ring 76, to actuate the brake of the mechanism. As hereinafter described, the brake is functional to provide a releasable locking of the inner sole 24 against vertical displacement, thereby providing for engagement and disengagement of the electrical generating mechanism.

Figure 2:
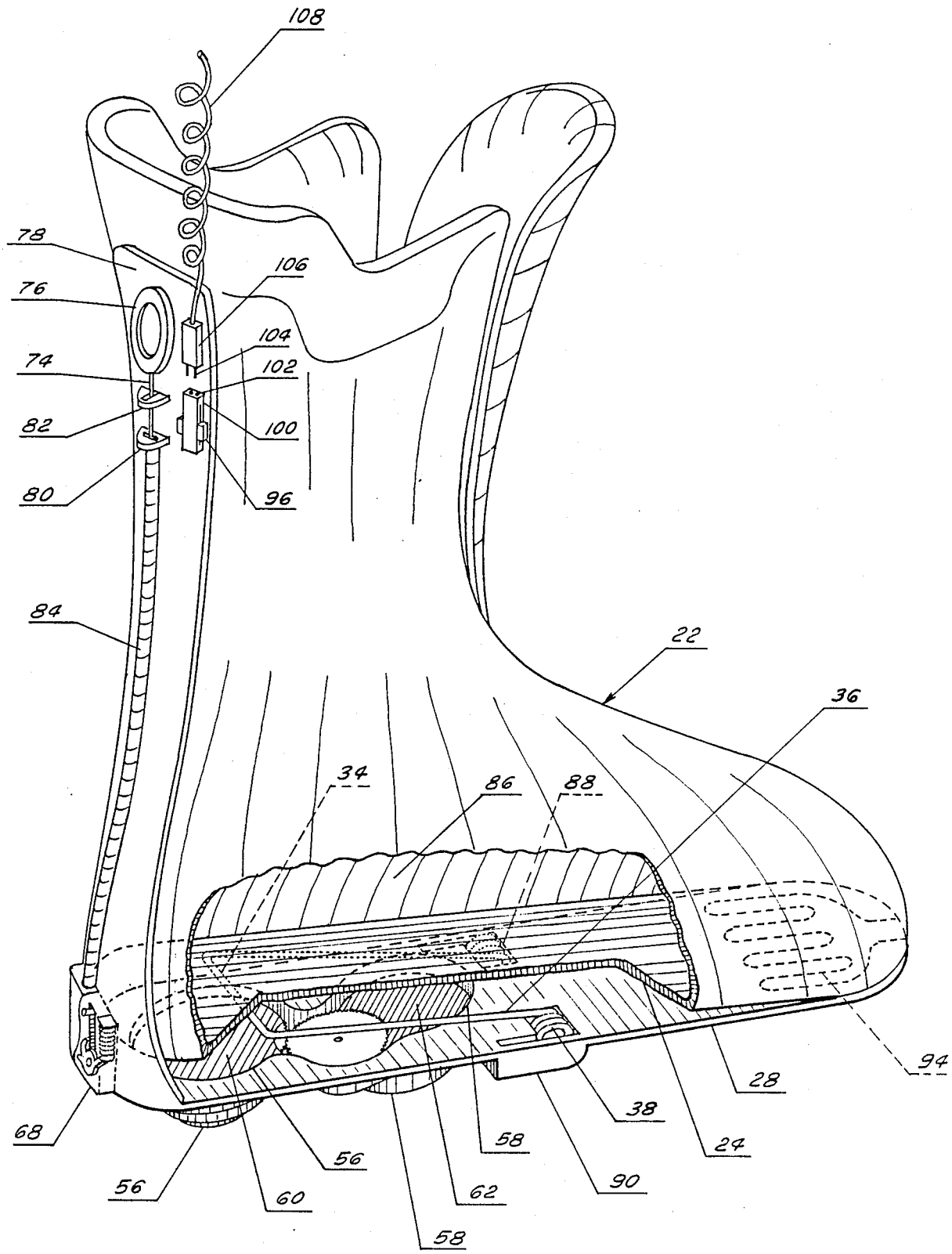
FIG. 2 is a perspective view of the inner shoe of the boot of FIG. 1.

Referring now to FIG. 2, the aforementioned elements are shown in a perspective, partially sectional view. The inner shoe 22 is formed of a molded, compressible plastic foam which is integrally sealed to a stiff bottom plate which forms the inner sole 24. The lower sole 28 which is integrally attached to the inner sole 24 at its toe end, is coextensive with the length and width of the inner sole 24 and at its heel end, supports a stiff or rigid vertical tab 78 that is formed as an integral molding of the lower sole 28. The tab 78 has brackets 80 and 82 at its upper end to receive the cable 74 which terminates in the pull ring 76 and which extends downwardly through a protective, flexible conduit 84 to the brake compartment 68. The interior of the inner shoe 22 can be formed with channels 86 about its entire interior surface, all as conventional for the construction of inner shoes of ski boots. A portion of the inner shoe 22 is cut away in the illustration to provide a window for viewing the construction features of the lower sole 28. As previously mentioned, the lower sole 28 is formed with a plurality of compartments 56 and 58 which receive the major components, the mechanical transducer 60, the gear box 62 and the electrical generator 64 of the warming mechanism. The compartments are generally cylindrical, reflecting the exterior cylindrical shapes of these elements and intersect to provide a single large pocket which is closed by cover plate 54 (see FIG. 1).

The lower sole 28 also has two pockets 88 and 90 laterally disposed adjacent the instep of the lower sole 28. The pockets 88 and 90 receive the helical windings of the torsion springs 38 that provide the resilient upward bias to the U-shaped arm 34 that urges the inner sole 24 in an upward direction. At its forward end, the inner sole 24 has a serpentine windings 94 of an electrical resistance heater which is molded or imbedded in the inner sole 24 and which, as hereinafter described, is in electrical continuity or circuit with the electrical generator 64 of the warming mechanism. Preferably, the electrical windings 94 are in circuit with the generator 64 through a switch 96 that is located on the upper rear surface of the rigid rear tab 78 whereby the electrical generator 64 can be placed in circuit with the windings 94, in circuit to electrical receptacles 102 in the connector block 100 or in circuit to both the windings 94 and the electrical receptacles 102. The electrical conductor receptacles 102 removable receive the connector prongs 104 of an electrical connector plug 106 that is secured to a two wire conductor 108 which can extend to other garments such as the gloves worn by the skier, thereby providing electrical power for heating elements contained in those other garments.

Figure 3:
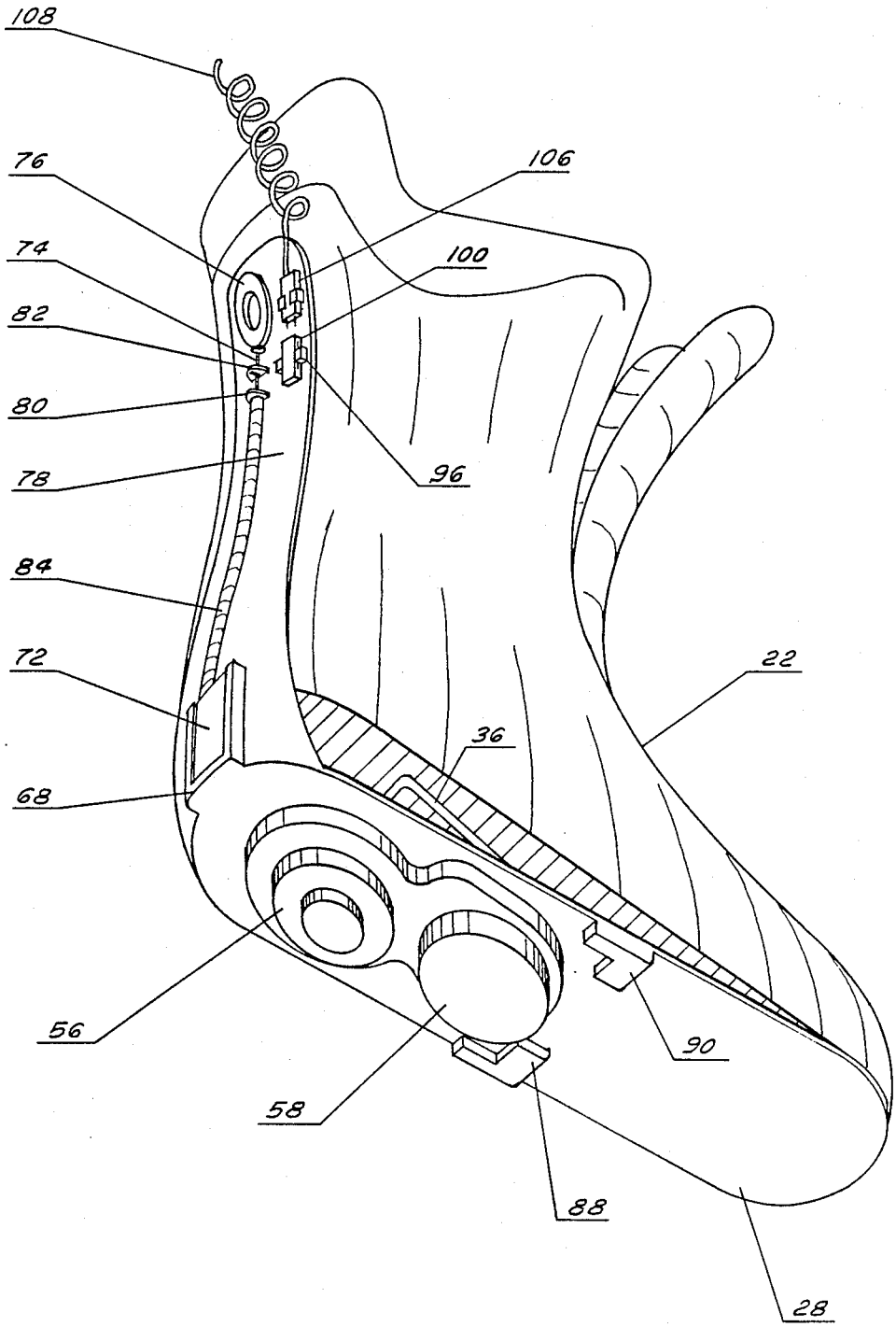
FIG. 3 is a perspective view from the underside of the inner shoe of FIG. 1.

Referring now to FIG. 3, a perspective view of the rear end under surface of the inner shoe 22 is illustrated. As there illustrated, the lower sole 28 has integrally molded compartments 56 and 58 on its undersurface at the heel and instep for the mounting of the aforementioned major components of the electrical generator mechanism. The laterally disposed pockets 88 and 90 which receive the resilient torsion springs 38 are also illustrated. As previously mentioned, the lower sole 28 also distally supports the brake compartment 68 which is formed as an integrally molded pocket at its heel end with a removable vertical plate 72 that is slidably received in the pocket to protect the moveable elements of the brake to prevent interference with the inner surfaces of the outer boot 10 that would obstruct free movement of these elements.

Figure 4:
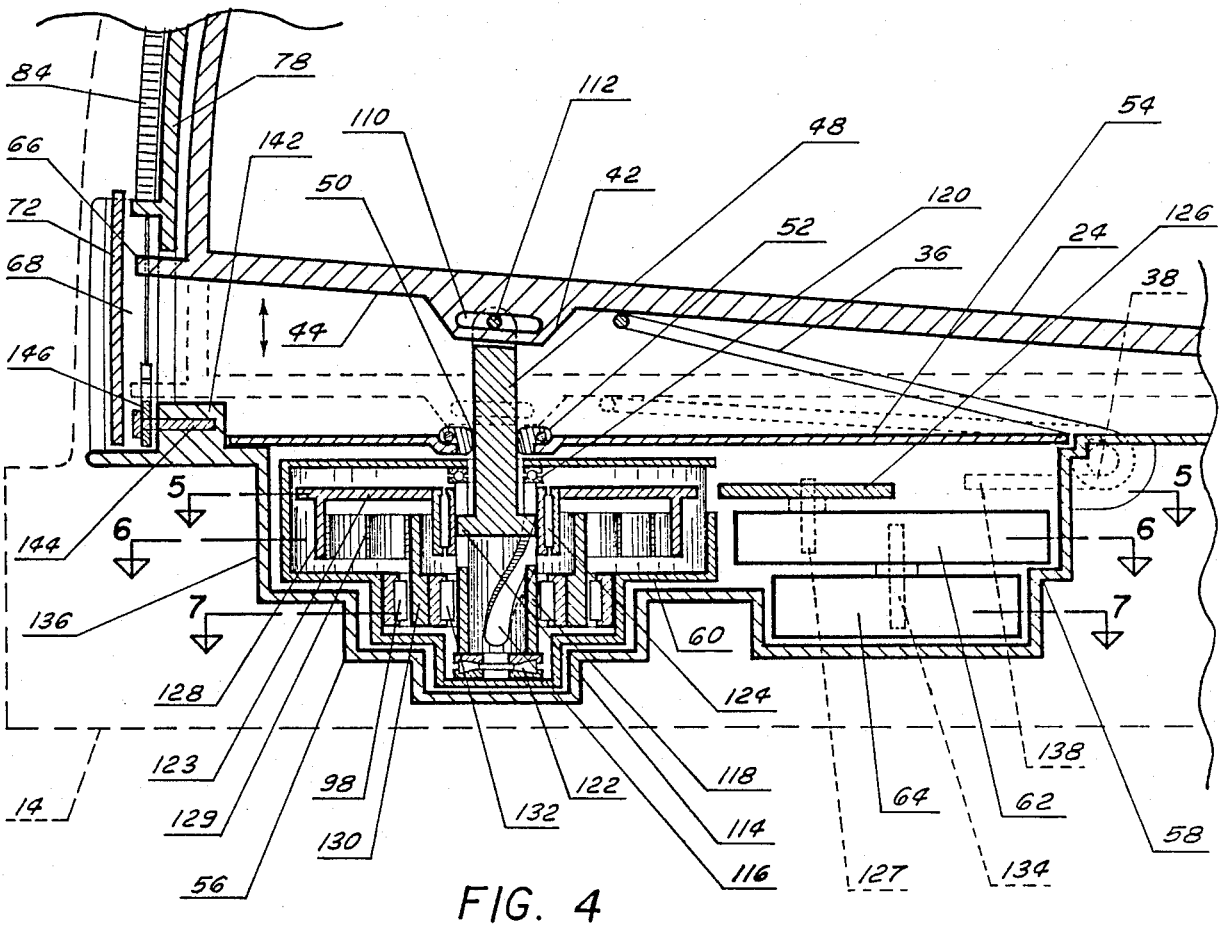
FIG. 4 is an elevational sectional view of the heel of the inner shoe, illustrating the mechanical units of the foot warmer invention.
Figure 5:
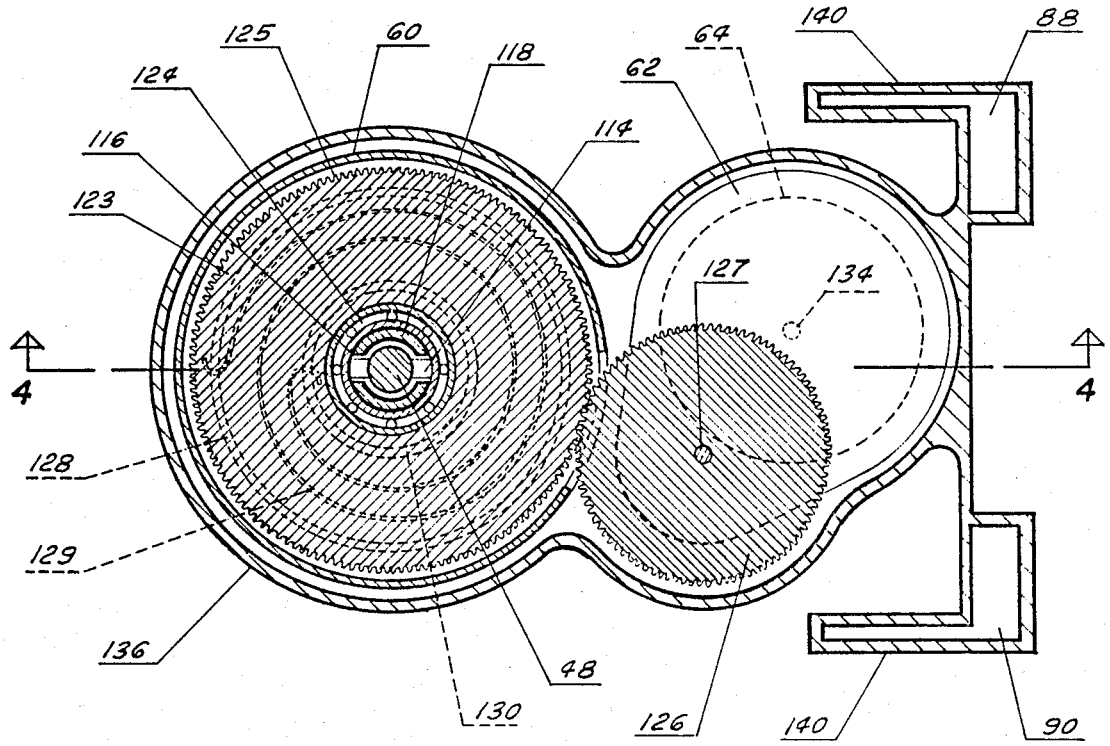
FIG. 5 is a sectional view along line 5—5' of FIG. 4.

Referring now to FIG. 4, there is illustrated an elevational sectional view through the heel and instep of the inner shoe 22, illustrating the elements of the major components. The inner sole 24 has an integrally molded dependent bracket 42 on its undersurface 44 having a longitudinal slot 110 which receives pin 112 that extends through the upper end of the vertical post 48. The large compartment formed by compartments 56 and 58 is covered by cover plate 54 having an aperture 50 to slidably receive post 48. An annular seal 52 is mounted in the aperture. Preferably the seal is a conventional seal with an internal spring which resiliently seals against the post 48 while permitting its free vertical movement. The lower end of the post has lateral pins 114 which project into a helical groove 116 in the wall of sleeve 118 which is mounted for free rotational movement between upper bearing 120 and lower thrust bearing 122. Flywheel 123 is mounted and rotationally received on sleeve 118 with a needle roller bearing 124 to provide free rotational movement. As shown in FIG. 5, the outer periphery of the flywheel 123 has gear teeth 125 which engage the driven gear 126 that is fixedly mounted on the shaft 127 of the gear box 62. The flywheel 123 has a downwardly dependent annular skirt 128 within which is nested a coiled helical spring 129 that provides a resilient mechanical linkage to the inner sleeve 130 which is also rotationally mounted on the drive sleeve 118. The drive sleeve 118 is connected to the inner sleeve 130 by rotational clutch mechanisms 98 and 132 which provide unidirectional rotation of the inner sleeve 130.

The remainder of the electrical generator mechanism is illustrated in block diagram and constitutes the gear box 62 that is internally mounted within a gear box housing 127 and which is mounted above the electrical generator 64 and connected thereto by generator shaft 134 which extends upwardly into a driven relationship within the gear box.

FIG. 5 illustrates the aforementioned elements along lines 5—5 of FIG. 4. As these illustrated, the outer wall 136 of the recessed compartments 56 and 58 is a continuous molded wall surrounding the mechanical transducer 60 and the gear box 62 and electrical generator 64. At its forward end, the wall forms laterally disposed pockets 88 and 90 which receive the torsion coil springs 38 (see FIG. 4). The base arm 138 of each torsion coil spring 38 is received in a pocket extension 140 of each of the laterally disposed pockets 88 and 90.

Referring to FIG. 4, the lower sole 28 has a raised integral block 142 at its heel end, which receives a machine screw fastener 144 for pivotal attachment of the brake latch, described in greater detail with reference to FIGS. 8–11. The lower sole 28 terminates with a brake pocket 68 formed on its rear surface and covered by vertical plate 72.

Figure 6:
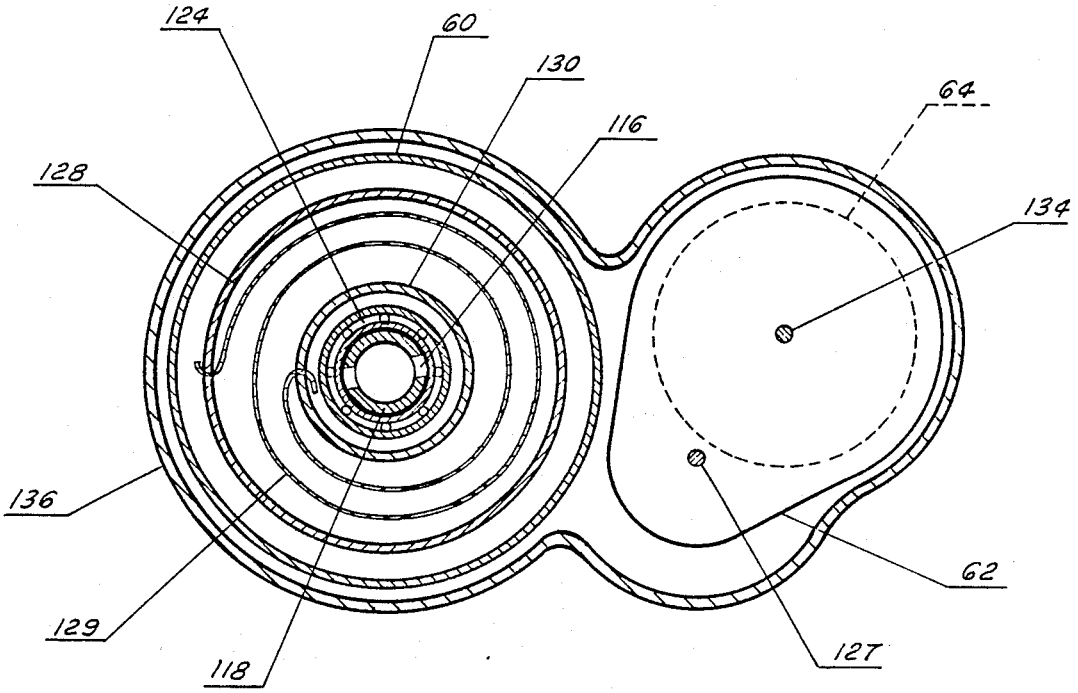
FIG. 6 is a view along line 6—6' of FIG. 4.

Referring now to FIG. 6, there is illustrated a view of the mechanical transducer 60 taken along lines 6—6 of FIG. 4. As there illustrated, the inner sleeve 130 is illustrated in a resilient interconnection to the annular skirt 128 of the flywheel 123 by the coiled helical spring 129. This resilient interconnection provides a shock absorbency to the mechanical transducer 60 so that in the event that the heel is driven downwardly in an abrupt movement as experienced during jumping, the mechanical shock of this movement is absorbed by the spring and is not directly transmitted to the flywheel 123. The view of FIG. 5 illustrates the needle roller bearings 124 which provide the free rotational mounting of the flywheel 123 on the drive sleeve 118 and also illustrates the helical groove 116 in the sidewall of the drive sleeve 118. The gear box 62, which is a commercially available unit, is shown in solid, unsectioned view. The preferred embodiment uses a reduction gearbox with a 300/1 gear ratio. The gearbox is permanently lubricated and is mounted with its "output shaft" being driven by the mechanical transducer, thereby multiplying the rotational speed of the unit. Motors, or generators can be clipped to the housing for easy assembly, permitting simple and quick interchange of generator or gearbox, or both.

Figure 7:
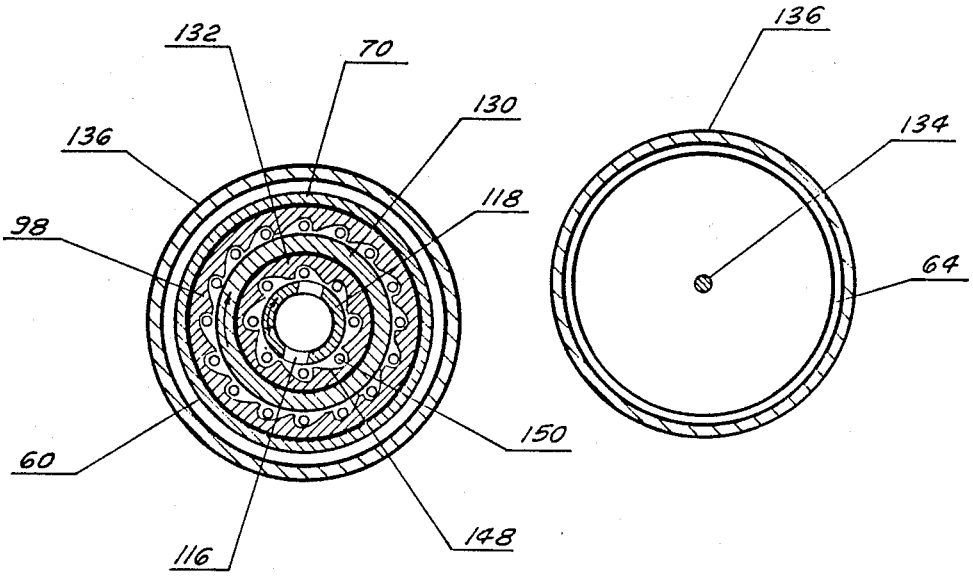
FIG. 7 is a view along line 7—7' of FIG. 4.
Figure 8:
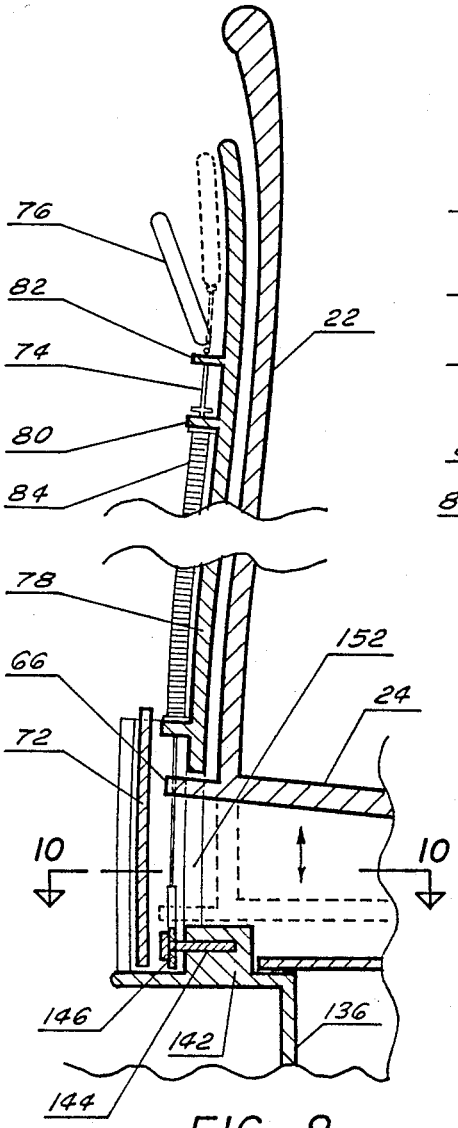
FIG. 8 is an elevational sectional view of the brake mechanism used with the shoe warmer.
Figure 9:
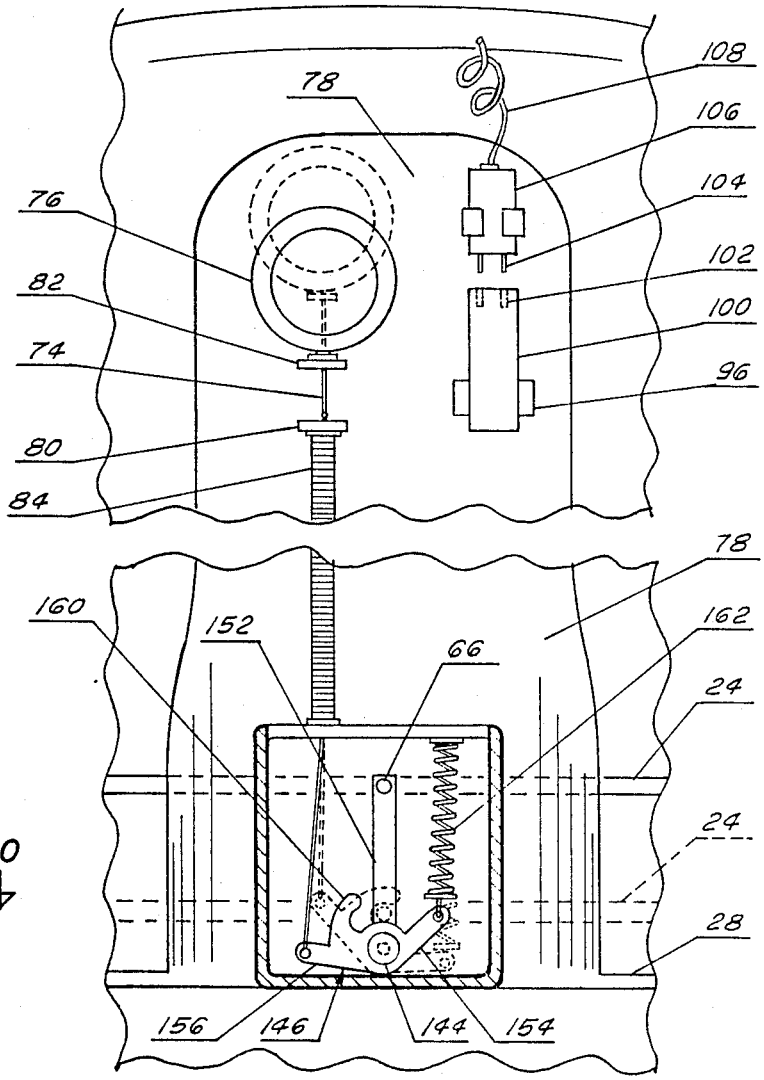
FIG. 9 is a view along line 9—9 of FIG. 10.
Figure 10:
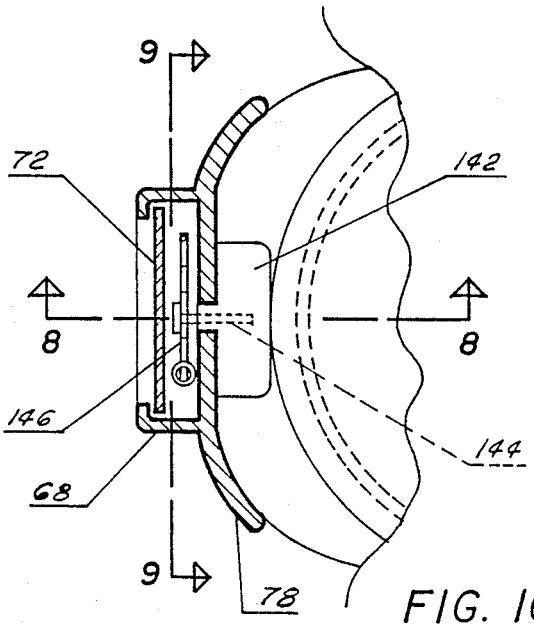
FIG. 10 is a view along line 10—10' of FIG. 8.

Referring now to FIG. 7 there is illustrated a sectional view along lines 7—7 of FIG. 4, through the escapement clutch mechanism 132 of the mechanical transducer 60. This clutch mechanism 132 is a conventional unit which is pressed into inner sleeve 130, and which functions by transmitting unidirectional rotational force from the rotational movements of the drive sleeve 118. The preferred embodiment uses a Torrington drawn cup roller clutch. Since the drive sleeve 118 is keyed to the vertical post 48 which undergoes reciprocal up and down movement, the drive sleeve 118 will rotate in opposite rotational directions. Only the clockwise rotational movement of the drive sleeve 118, however, will be transmitted to the inner sleeve 130 which surrounds the lower end of the drive sleeve 118 as the clutch mechanism effectively transmits only clockwise rotational movement. This occurs since the cam surfaces 148 in the inner sleeve 130 are only engaged by rollers 150 when they become wedged against the inclined cam surfaces 148. The opposite or counter-clockwise rotation as viewed in FIG. 7, is effective to move the rollers 150 out of their wedged relationship, freeing the drive sleeve 118 for rotation without movement of the inner sleeve 118.

A second escapement clutch mechanism 98 is also provided and is frictionally seated in wall 70 of the transducer 60 to prevent rotation of the inner sleeve 130 in a counterclockwise direction, as viewed in FIG. 7.

The electrical generator mechanism is a conventional electrical direct current motor which is capable of operation as a generator. A wide variety of electrical motors can be used for this purpose; generally motors which can generate from 1 to 10 watts at speeds of from 4000 to 12000 revolutions per minute are quite suitable. The preferred motor has a 12 pole ferrite magnet and generates approximately 2 watts at 7000 rpm. As this is a conventional unit, it is simply shown in the sectional view as a solid body.

Figure 11:
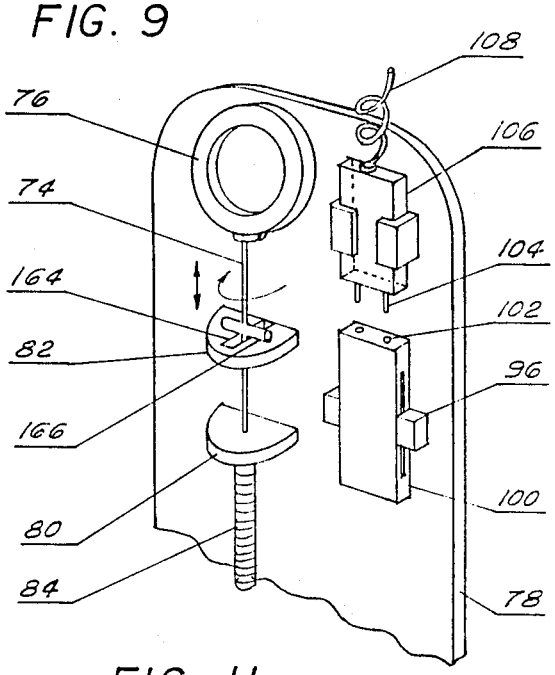
FIG. 11 is a view of the upper end of the rear tab of the inner shoe.

Referring now to FIGS. 8 through 11, the brake mechanism will be described in greater detail. As previously described, the lower sole 28 supports, at its heel end, the vertical tab 78 which has a vertical slot 152 to receive the tab 66 at the end of the inner sole 24. The length of this vertical slot 152 provides the limits of travel for the heel and post 48. The brake mechanism comprises a latch 146 that is pivotally secured to lock onto the tab 66 on the heel of the inner sole 24. Latch 146 has a spring arm 154 and an actuator arm 156 with a latching finger 160. The spring 162 resiliently biases the mechanism into an unlatched position, which is shown by the solid lines. When the cable 74 is pulled upwardly, the latch finger 160 is rotated into engagement with tab 66, thereby locking the tab 66 and its dependent inner sole 24 in the depressed position, all as shown by the phantom lines in FIGS. 8, 9 and 10. As shown in FIG. 11, the cable 74 extends upwardly through a mounting bracket 80 and a locking bracket 82 which has a single elongated slot 164. A pin 166 is transversely permanently secured to the cable 74 so that when it is pulled through the slot 164 and rotated, as shown in FIG. 11, it will lock the cable 74 against retraction, thereby securing the latch finger 160 in its detenting position against the bias of the spring 162.

As previously mentioned, the mechanism also includes a connector block 100 having a manual switch 96 to permit disconnecting the electrical generator from the conductors supplying electrical energy to the serpentine windings in the toe of the shoe. The switch also has switch levers which can be opened or closed in circuit to the windings 94 and/or to the receptacles 102 of connector block 100 to permit the application of the electrical power to shoe heater, or to the receptacles 102, respectively. As previously mentioned, receptacles 102 removably receive the connector plug 106 attached to conductor 108 that extends to heating elements in other wearing apparel such as mittens, pants, jackets and the like. In this manner, the electrical power can be switched to either or both the toe heater and heaters in other wearing apparel.

Figure 12:
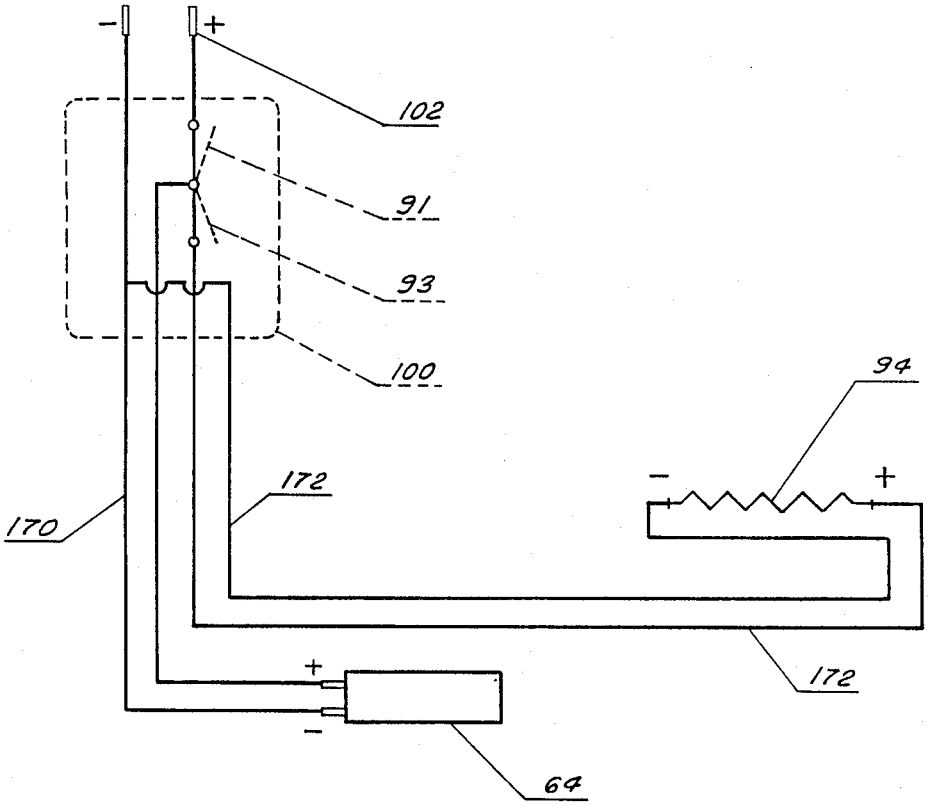
FIG. 12 is an electrical schematic of the foot warmer circuits.

FIG. 12 illustrates an electrical schematic of the circuit in which the power developed from the electrical generator is transmitted by the power conductors 170 to the connector block 100 and from there is transmitted through switch lever 93 to conductors 172 that extend along the lower sole 28 to electrical contact with the serpentine windings 94 in the toe of the shoe. The switch also includes lever 91 which is in circuit to receptacles 102 to provide electrical power to those receptacles. Switch levers 91 and 93 are shown in closed positions in solid lines and open positions in phantom lines.

Figure 13:
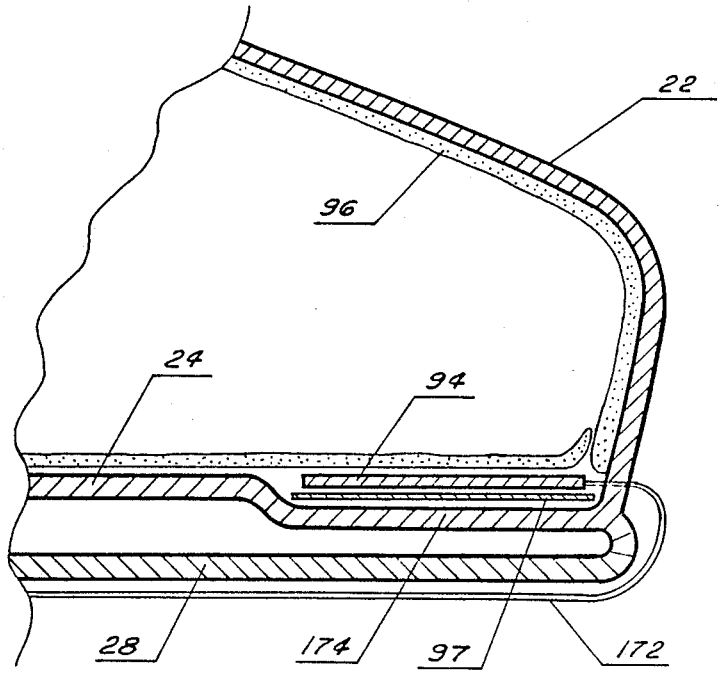
FIG. 13 is an elevational sectional view of the toe of the inner shoe.

FIG. 13 illustrates the electrical conductors 172 which extend along the undersurface of the lower sole 28 into contact with the electrical heating windings 94 mounted within a pocket 174 molded into the toe end of the inner sole 24. Conductors 172 can be a Mylar flex circuit, in which copper foil conductors are molded within a Mylar film. Even though illustrated as spaced apart from the sole surfaces, the Mylar flex circuit conductors could be molded directly into the plastic of the inner shoe.

The invention is readily adaptable to the conventional molded plastics ski boots which are presently marketed. The electrical generating elements are mounted within compartments which are sealed to the atmosphere. The elements are, however, readily accessible by removal of the cover plate 54, so that the transducer, gearbox, or generator can be removed and replaced. This permits adjustment of the electrical generator mechanism to the individual, and to the severity of climatic conditions which may be experienced. It also provides for easy repair and replacement of worn or broken mechanical parts.

The invention has been described with reference to the illustrated and presently preferred embodiment. It is not intended that the invention be unduly limited by this disclosure of the presently preferred embodiment. Instead, it is intended that the invention be defined, by the means, and their obvious equivalents, set forth in the following claims:

What is claimed is:

1. In a foot warmer mechanism for a shoe having a heel with an open compartment and an outer sole and having an inner sole mounted within said shoe for relative vertical movement therein and with a mechanical translator located in said open compartment of said heel and mechanically linked to the reciprocal vertical movement of said inner sole and electrical generation means seated in said compartment within said heel and including a gearbox and a mechanically interconnected electrical generator and electrical heating means within said shoe in circuit to said electrical generator, the improvement comprising:.

a. a flywheel mounted for rotational movement on a vertical axis in the heel of said shoe and mechanically coupled through said gearbox to said electrical generation means;

b. a sleeve coupled to said mechanical transducer also mounted in the heel of said shoe coaxial with said flywheel; and c. a resilient helical coil spring with its inner end secured to said sleeve and its outer end secured to said flywheel, whereby rotational movement of said sleeve is resiliently transmitted to said flywheel, and said spring absorbs the shock from impacts applied to said sleeve by rapid and forceful movements of said inner sole.

2. The improvement of claim 1 wherein said sleeve has a spiral track along its wall and said inner sole supports a vertical post with an orthogonal pin which is received within said sleeve with an end of said pin projecting into said spiral groove, whereby reciprocal vertical movements of said integral sole are translated to rotational movements of said sleeve.

3. The improvement of claim 2 including a resilient spring mounted within said shoe, beneath said inner sole to bias said inner sole upwardly against the foot of the wearer of the shoe.

4. In a ski boot of the construction having an outer molded plastic shell and an inner shoe lining, and a molded inner shoe having an upper portion with an integral sole and a contour conforming to the inner shape of said shell, the improvement comprising:

a lower sole coextensive with said integral sole of said inner shoe and pivotally secured thereto at the toe of said shoe, and having at least a first open-topped compartment of a size and shape to fit within the heel area of said outer shell;

a removable cover plate fitted over said first open-topped compartment to close said compartment; and electrical generation means removably seated in said open-top compartment within said heel area and including a gearbox and a mechanically interconnected electrical generator.

5. The improvement of claim 4 including a resilient spring mounted within said shoe, beneath said integral sole to bias said integral sole upwardly against the foot of the wearer of the shoe.

6. The improvement of claim 5 wherein said shoe includes at least a second open-topped compartment which fits within the instep area of said outer shell and which receives said resilient spring.

7. The ski boot of claim 6 including a removable cover plate which fits over both said first and second open-topped compartments in said heel and in said instep areas of said shoe, to close said compartments.

8. The ski boot of claim 4 wherein said lower sole supports a vertical tab at its heel which extends upwardly to the top of said shell.

9. The ski boot of claim 8 including a brake compartment in the lower end of said vertical tab.

10. The ski boot of claim 9 including a vertical slot in said vertical tab opening into said brake compartment, and including a distal tab on the heel of said integral sole which projects into said brake compartment.

11. The ski boot of claim 10 including a latch within said brake compartment and pivotally mounted on said vertical tab between a recessed position and an advanced position engaging said distal tab.

12. The ski boot of claim 11 including a cable extending along from the upper end of said vertical tab to said brake compartment where it is fixedly secured to said latch, thereby serving as a remote cable actuator for said latch.

13. In a ski boot of the construction having an outer molded plastic shell and an inner shoe lining and a molded inner shoe having an upper portion with an integral sole and a contour conforming to the inner shape of said shell, the improvement comprising:

a lower sole coextensive with said integral sole of said inner shoe and pivotally secured thereto at the toe of said shoe, and having at least a first open-topped compartment of a size and shape to fit within the heel area of said outer shell;

at least a second open-topped compartment which fits within the instep area of said outer shell; and electrical generation means including a gearbox and a mechanically interconnected electrical generator removably seated in said first open-top compartment within said heel area and a resilient spring mounted within said second compartment within said instep area of said shoe, beneath said inner sole to bias said inner sole upwardly against the foot of the wearer of the shoe.

14. The ski boot of claim 13 including a removable cover plate that fits over said open-topped compartments to enclose said compartments.

15. The ski boot of claim 13 wherein said lower sole supports a vertical tab at its heel which extends upwardly to the top of said shell.

16. The ski boot of claim 15 including a brake compartment in the lower end of said vertical tab, and brake means effective to lock said electrical generation means out of operation.

17. The ski boot of claim 16 including a switch mounted on the upper end of said vertical tab, and first electrical conductor means extending from said electrical generator to said switch, and an electrical resistance heater in the toe of said boot with second electrical conductor means extending from said switch to said electrical resistance heater.

18. The ski boot of claim 15 including an electrical connector block with electrical receptacles to receive a removable electrical plug and third electrical conductor means extending from said switch to said electrical receptacles.

19. The ski boot of claim 18 including a cable extending from the upper end of said vertical tab to said brake compartment where it is secured to said brake means, thereby serving as a remote cable actuator for said brake means.

* * * * *